United States Patent [19]

Laitinen et al.

[11] Patent Number: 4,690,735

[45] Date of Patent: Sep. 1, 1987

[54] ELECTROLYTIC BATH COMPOSITIONS AND METHOD FOR ELECTRODEPOSITION OF AMORPHOUS CHROMIUM

[75] Inventors: Herbert A. Laitinen, Gainesville, Fla.; Shigeo Hoshino, Kawasaki, Japan

[73] Assignee: University of Florida, Gainesville, Fla.

[21] Appl. No.: 825,977

[22] Filed: Feb. 4, 1986

[51] Int. Cl.[4] ..... C25D 3/04

[52] U.S. Cl. ..... 204/37.1; 204/51; 148/133

[58] Field of Search ..... 204/51, 105 R, 37.1, 204/38.1; 148/133

[56] References Cited

U.S. PATENT DOCUMENTS

| | | | |
|---|---|---|---|
| 3,065,184 | 11/1962 | Harvey | 204/51 X |
| 3,069,333 | 12/1962 | Deyrup | 204/51 |
| 4,406,756 | 9/1983 | Baranyi | 204/51 |

OTHER PUBLICATIONS

Ageenko, *Chemical Abstracts,* 77–Electrochemistry, vol. 73, 1970, 51691r.

Kasaaiaw, *Chemical Abstracts*, vol. 102, 1985, 35303c.

Tsuru, *Chemical Abstracts,* vol. 98, 1983, 224132f.

Bharucha, *Chemical Abstracts,* vol. 70, 1969, 102533p.

Mori, *Chemical Abstracts,* vol. 93, 1980, 56938z.

*Primary Examiner*—T. Tung

*Attorney, Agent, or Firm*—Dennis P. Clarke

[57] ABSTRACT

An electroplating bath for depositing amorphous chromium material comprising organic additives and a chromium trioxide to sulfuric acid weight ratio of from about 2:1 to about 40:1.

13 Claims, No Drawings

ELECTROLYTIC BATH COMPOSITIONS AND METHOD FOR ELECTRODEPOSITION OF AMORPHOUS CHROMIUM

BACKGROUND OF THE INVENTION

1. Field of the Invention

The invention relates to chromium electroplating, and more particularly to improved electrolytic bath compositions and methods therefor and substrates coated electrolytically with chromium.

2. Prior Art

Present day commercial chromium plating processes are based on the electrolysis of chromium trioxide, $CrO_3$ (chromic acid) solutions containing small amounts of a catalyst, e.g., sulfuric acid, fluorides, etc. In these commercial processes for the production of bright plates of acceptable quality the current density and temperature during plating must be closely controlled. Even when closely controlling the current density, temperature and other variable parameters such as chromic acid-catalyst ratio, etc., the throwing power of the plating bath is very low as compared to other metal plating processes. Because of the poor throwing power it is often necessary to provide anodes conforming to the shape of the object to be plated. Moreover, the current efficiency of commercial plating baths is usually no greater than 8–12% and under the most optimum condition only about 15%, possibly as high as 20% in rare instances.

Also, objectionably large volumes of oxygen and hydrogen are given off during conventional plating operations, resulting in a highly noxious and corrosive spray of chromic acid over the plating bath during the plating process. Moreover, large amounts of chromic acid are lost by drag-out and spray due to the necessity for employing rather large amounts of chromic acid in commercial baths.

In addition, conventionally electroplated chromium deposits have hardness values unacceptable for many applications, i.e., on the order of 800–950 Hv (Vickers Hardness). Also, at elevated temperatures the hardness values of conventionally plated chromium layers decreases, e.g., from 900 Hv to 400 Hv at 500° C., thereby decreasing the wear resistance of conventional plated substrates.

Finally, conventional chromium plating methods result in a large number of relatively large cracks in the plated layer rendering it subject to corrosion.

It is an object of the present invention to provide an electrolytic bath composition and electroplating method for electrodepositing chromium layers having exceptionally high hardness values.

It is a further object of the present invention to provide an electrolytic bath composition and electroplating method for electrodepositing chromium at higher current efficiencies and for producing chromium layers having a higher degree of brightness and less subject to corrosion of the underlying substrate.

It is a further object of the invention to provide novel substrates electrolytically plated with chromium.

SUMMARY OF THE INVENTION

These and other objects of the invention are realized by providing a composition of matter for electrodepositing an amorphous, bright chromium material having a hardness value above about 950 Hv comprising an aqueous solution containing:

(a) from about 20 to about 200 g/l of chromium trioxide ($CrO_3$), (b) an amount of a source of formic acid, formaldehyde, glyoxal or formamide sufficient to provide from about 2 to about 30 g/l of (1) formic acid, calculated on 85% formic acid, and/or (2) formaldehyde, calculated on 35% formaldehyde, and/or (3) glyoxal, calculated on 40% glyoxal and/or (4) formamide, calculated on 98% formamide, and (c) an amount of a source of sulfuric acid sufficient to provide a weight ratio of chromium trioxide to sulfuric acid in said solution in the range of from about 2:1 to about 40:1.

There is also provided, according to another embodiment of the present invention, a method for the electroplating of an amorphous, bright layer of chromium material having a hardness value above about 950 Hv comprising passing a direct electric current having a current density in the range of from about 5 to about 300 A/dm2 between an inert anode and a metallic cathode in an electrolytic plating bath comprising an aqueous solution containing:

(a) from about 20 to about 200 g/l of chromium trioxide ($CrO_3$), (b) an amount of a source of formic acid, formaldehyde, glyoxal or formamide sufficient to provide from about 2 to about 30 g/l of (1) formic acid, calculated on 85% formic acid, and/or (2) formaldehyde, calculated on 35% formaldehyde, and/or (3) glyoxal calculated on 40% glyoxal and/or (4) formamide, calculated on 98% formamide, and (c) an amount of a source of sulfuric acid sufficient to provide a weight ratio of chromium trioxide to sulfuric acid in said solution is in the range of from about 2:1 to about 40:1.

There is also provided, according to a further embodiment of the present invention, a method for increasing the hardness of a chromium layer electroplated by the above described method comprising heat treating the layer for a time sufficient to increase the hardness thereof.

The present invention also provides, according to a still further embodiment thereof, a substrate electroplated with chromium according to the above described method.

Finally, there is provided, according to another embodiment of the present invention, a substrate electroplated with chromium and heat treated according to the above described methods.

DETAILED DESCRIPTION OF THE INVENTION

Prior researchers have proposed the addition of organic additivies such as formic acid, formamide and formaldehyde to various chromium electroplating and electroless plating bath compositions to achieve various results. See U.S. Pat. Nos. 3,021,267; 2,822,326; 3,021,267; 2,801,214; 3,069,333; 4,184,929; Ageenko et al, Otkrytiya, Izobret., prom. Obraztsy, Tovarnye Znaki, Vol. 47(11), p. 176 (1970); Kasaaian et al, Plat. Surf. Finish, Vol. 71(11), pp. 66-73 (1984); Trusu et al, Kinzoku Hyomen Gijutsu, Vol. 34(1), pp. 12-18 (1983); British Patent 1,144,913 and Japanese Patent No. 80/31,119.

In each case, however, the organic additive(s) are employed either (1) in trivalent chromium plating baths to function as reducing agents, thereby preventing the formation of hexavalent chromium during the plating operation or (2) in hexavalent chromium plating baths to improve the current efficiency of the electrodeposition.

The additives have also been employed in "chromatizing" or electroless chromium plating methods which differ substantively from electroplating methods in that electrolysis is not employed and the object of the process is to provide very thin films of chromate rather than chromium on the substrate to be "plated".

The present invention is predicated on the discovery that the addition of one or more of these additives to chromium trioxide electrolytic plating baths having the specific compositions set forth above, enables the electrodeposition of chromium layers having an amorphous structure and much higher hardness values than the crystalline chromium layers provided by conventional chromium trioxide based electrolytic methods.

It was further unexpectedly discovered that the additives greatly increase the current efficiency of the plating method and result in much brighter chromium layers with the tendency to form fewer and smaller cracks therein than conventionally produced deposits.

The amorphous chromium layers electrodeposited according to the present invention have hardness values above 950 Hv. According to another embodiment of the invention, it has also unexpectedly been found that heat treatment of the amorphous chromium layer at temperatures above about 500° C. for relatively short periods of time, i.e., on the order of about 1 hour, raises the hardness values to as high as 1800 Hv.

It has been found that heat treatment of the novel amorphous chromium layer results in the formation of a very hard chromium carbide layer thereon from the residue of organic additives present on the plated surface. Some increase in hardness occurs at about 600° C. due to an initial formation of surface oxides and sulfides on the chromium surface; however, a significant increase in hardness results from more elevated temperature heat treatments which result in carbide formation.

Current efficiencies when employing the baths of the invention are of the order of 25%, significantly greater than the 15% current efficiencies achieved with commercial baths. The baths of the present invention thereby enable faster and more efficient plating.

The novel Cr deposits made possible by the invention show amorphous structures as measured by X-ray and electron diffraction analysis. The substrates underlying the Cr deposits of the invention possess enhanced corrosion resistance due to the fact the cracks in the chromium layers are fewer in number and much smaller than those of the prior art thereby exposing less of the chromium layer. Moreover, the carbide layers of the heat treated surfaces offer additional corrosion resistant characteristics to the chromium layer.

It is critical that the concentration of chromic acid ($CrO_3$, chromium trioxide) be maintained in the range of 20–200 g/l of the bath.

In conventional commercial Cr plating baths, the ratio of $CrO_3$ to sulfuric acid is maintained within the range of 50:1 to 200:1. In the baths of the present invention, the ratio of $CrO_3$ to sulfuric acid must be maintained within the range of from about 2:1 to 40:1, preferably from about 5:1 to about 30:1.

It is also critical to the success of the invention that the concentrations of the organic additives be in the range of 2–30, preferably 5–30 g/l of (1) formic acid calculated on 85% formic acid, (2) formamide, calculated on 98% formamide, (3) glyoxal, calculated on 40% glyoxal and (4) formaldehyde, calculated on 35% formaldehyde.

It will be understood by those skilled in the art that additives may be employed in the bath which produce formic acid and or formaldehyde and/or formamide, in situ, under the conditions of plating. For example, it has been found that imidazole is converted by the plating bath conditions to one or more of the above additives. The present invention therefore includes the use of any source of the above listed additives which converts under the bath conditions to an amount of the required additive sufficient to produce the desired results.

The temperature of the bath should be maintained at less than about 45° C. in order to avoid undue oxidation of the organic additives.

The presence of the organic additives in the chromic acid bath gradually produces trivalent chromium ions due to reduction of the organic compounds. Moreover, the organic compounds are also oxidized anodically during electrolysis. Since the increase of trivalent chromium in the bath prevents deposition of chromium with a smooth surface, it is important to keep the concentration of trivalent chromium ion at less than about 15% by weight of the chromic acid present therein. In order to maintain the concentration of bath within suitable conditions, it is necessary to oxidize trivalent Cr to chromic acid by electrolytic oxidation methods.

It will be appreciated by those skilled in the art that by the term, "source of sulfuric acid", used herein is meant any material otherwise inert to the bath and electrolytic method which produces the necessary amount of sulfuric acid in situ, e.g., ammonium sulfate, etc.

Inasmuch as a high concentration of chromic acid in the bath promotes oxidation of organic additives and a low concentration of the acid prevents the deposition of Cr metal, the concentration of chromic acid in the bath must be kept in the range of 20–200 g/l.

The concentration of organic additives in this invention should be kept within the range of 2–30 g/l, inasmuch as a bath containing less than 2 g/l yields no amorphous Cr deposits and a bath with more than 30 g/l results in low current efficiency.

The current density required to deposit amorphous Cr is in the range of 5–300 A/dm$^2$. A low current density of less than 5 A/dm$^2$ yields no depositions of Cr. The use of high current density over 300 A/dm$^2$ makes it difficult to pass a current to the substrate to be plated.

The following examples illustrate certain preferred embodiments of the invention.

EXAMPLE 1

An electrolytic plating bath was made of the following composition:

| | |
|---|---|
| Chromic acid | 100 g/l |
| Sulfuric acid | 5 g/l |
| Formic acid (85%) | 20 ml/l |
| (Trivalent Cr ion) | 1–15 g/l |
| Temperature of bath | 15–40° C. |
| Current density | 10–100 A/dm$^2$. |

Using the above conditions, a mild steel substrate was electrolytically plated with chromium. The Cr deposits obtained at 30° C. and 40 A/dm$^2$ had a mirror surface and showed an amorphous structure by X-ray and electron diffraction analysis. The hardness values of the deposits were in the range of Hv950–1000. After heat treatment at 600° C. for one hour, the hardness value increased to Hv1600–1800. Moreover, the heat treated chromium layer demonstrated corrosion resistance three times higher than conventionally plated Cr when exposed to 1:1 Hcl solutions.

EXAMPLE 2

Example 1 was repeated using a bath of the composition:

| | |
|---|---|
| Chromic acid | 50 g/l |
| Ammonium sulfate | 3 g/l |
| Formic acid (85%) | 15 ml/l |
| Temperature | 15–45° C. |
| Current density | 10–60 A/dm$^2$. |

The deposits, using the above bath, had the same characteristics as that of Example 1.

EXAMPLE 3

Example 1 was repeated utilizing a bath of the following composition:

| | |
|---|---|
| Chromic acid | 150 g/l |
| Sulfuric acid | 10 g/l |
| Formamide | 25 ml/l |
| Temperature | 15–30° C. |
| Current density | 10–100 A/dm$^2$. |

The deposits, using the above bath, had the same characteristics as that of Example 1.

EXAMPLE 4

Example 1 was repeated utilizing a bath of the following composition:

| | |
|---|---|
| Chromic acid | 80 g/l |
| Sulfuric acid | 5 g/l |
| Formaldehyde | 50 ml/l |
| Temperature | 15–40° C. |
| Current density | 10–40 A/dm$^2$. |

The deposits, using the above bath, had the same characteristics as that of Example 1.

EXAMPLE 5

Example 1 was repeated utilizing a bath of the following composition:

| | |
|---|---|
| Chromic acid | 100 g/l |
| Sulfuric acid | 5 g/l |
| Glyoxal | 20 ml/l |
| Temperature | 15–40° C. |
| Current density | 10–80 A/dm$^2$. |

The deposits, using the above bath, had the same characteristics as that of Example 1.

We claim:

1. A composition of matter for electrodepositing an amorphous, bright chromium material having a hardness value above about 950 Hv comprising an aqueous solution containing:

(a) from about 20 to about 200 g/l of chromium trioxide ($CrO_3$), (b) an amount of a source of formic acid, formaldehyde, glyoxal or formamide, sufficient to provide from about 2 to about 30 g/l of (1) a member selected from the group consisting of formic acid, calculated on 85% formic acid, (2) formaldehyde, calculated on 35% formaldehyde, (3) glyoxal, calculated on 40% glyoxal or (4) formamide, calculated on 98% formamide, and mixtures thereof, and (c) an amount of a source of sulfuric acid sufficient to provide a weight ratio of chromium trioxide to sulfuric acid in said solution in the range of from about 2:1 to about 40:1.

2. A composition according to claim 1 wherein the weight ratio of chromium trioxide to sulfuric acid is in the range of from about 5:1 to about 30:1.

3. A composition according to claim 2 containing from about 5 to about 30 g/l of said formic acid, formaldehyde or formamide.

4. A composition according to claim 1 wherein the amount of trivalent chromium ions present in said solution is less than about 30% of the weight of chromium trioxide.

5. A method for the electroplating of an amorphous, bright layer of chromium material having a hardness value above about 950 Hv comprising passing a direct electric current having a current density in the range of from about 5 to about 300 A/dm$^2$ between an inert anode and a metallic cathode in an electrolytic plating bath comprising an aqueous solution containing:

(a) from about 20 to about 200 g/l of chromium trioxide ($CrO_3$), (b) an amount of a source of formic acid, formaldehyde, glyoxal or formamide sufficient to provide from about 2 to about 30 g/l of a member selected from the group consisting of (1) formic acid, calculated on 85% formic acid, (2) formaldehyde, calculated on 35% formaldehyde, (3) glyoxal, calculated on 40% glyoxal, (4) formamide, calculated on 98% formamide, and (5) mixtures thereof, (c) an amount of a source of sulfuric acid sufficient to provide a weight ratio of chromium trioxide to sulfuric acid in said solution in the range of from about 2:1 to about 40:1.

6. A method according to claim 5 wherein the weight ratio of chromium trioxide to sulfuric acid is in the range of from about 5:1 to about 30:1.

7. A method according to claim 5 containing from about 5 to about 30 g/l of said formic acid, formaldehyde or formamide.

8. A method according to claim 5 wherein the amount of trivalent chromium ions present in said solution is maintained at less than about 15% of the weight of chromium trioxide.

9. A method according to claim 8 wherein the amount of trivalent chromium ions is maintained at less than about 15% by weight of chromium trioxide by oxidation of excess trivalent chromium ions to chromic oxide by electrolytic oxidation.

10. A method according to claim 5 wherein the temperature of said bath is maintained at less than about 45° C.

11. A method according to claim 5 wherein the hardness of said electroplated chromium material is increased by heat treating said layer at a temperature above about 500° for a time sufficient to form a carbide layer on said electroplated chromium material from the residue of said plating bath remaining thereon to thereby increase the hardness thereof.

12. A method according to claim 11 wherein the hardness of said electroplated chromium layer is increased by heating said layer to a temperature above about 500° C. for about one hour.

13. A substrate electroplated with an amorphous chromium material and heat treated according to the method of claim 12.

* * * * *